United States Patent [19]

Epis

[11] Patent Number: 4,471,814

[45] Date of Patent: Sep. 18, 1984

[54] LOOM DOBBY READING UNIT

[75] Inventor: Olivo Epis, Ponte Nossa, Italy

[73] Assignee: Fimtessile Fabbrica Italiana Macchinario Tessile S.p.A., Italy

[21] Appl. No.: 405,361

[22] Filed: Aug. 5, 1982

[30] Foreign Application Priority Data

Aug. 6, 1981 [IT] Italy ..... 23411 A/81

[51] Int. Cl.[3] ..... D03C 1/14

[52] U.S. Cl. ..... 139/68; 139/331

[58] Field of Search ..... 139/66–74, 139/331

[56] References Cited

U.S. PATENT DOCUMENTS 3,277,928 10/1966 Ozga ..... 139/68

3,848,643 11/1974 Wicker ..... 139/68

4,187,886 2/1980 Palau ..... 139/68

FOREIGN PATENT DOCUMENTS 2744422 4/1978 Fed. Rep. of Germany ..... 139/68

*Primary Examiner*—James Kee Chi

*Attorney, Agent, or Firm*—Stevens, Davis, Miller & Mosher

[57] ABSTRACT

The invention provides improvements in the members of a loom dobby reading unit, which enable the reading unit and control unit to be structurally separated. For this purpose, the reading unit rockers act on the control unit by simple bearing and thrust contact between a tappet provided on the rockers and the horizontal needles for the lifting rods of the control unit hooks. In addition, there are provided a very rigorous guide for the reading unit rocker movements, an improved mechanism for controlling the lowering movements of the rocker thrust rods, and an improved mechanism for controlling the pressure bars, said mechanisms both using precise cam controls.

4 Claims, 4 Drawing Figures

LOOM DOBBY READING UNIT

BACKGROUND OF THE INVENTION

This invention relates to improvements in the members of a loom dobby reading unit, in order to enable it to be structurally separated from the dobby control unit, and to improve the construction, operation and maintenance of these units.

SUMMARY OF THE INVENTION

According to the invention, the dobby reading unit is structurally separate from the control unit, the first unit acting on the second by bearing and thrust content between tappets on the reading unit rockers and the ends of the horizontal needles of the control unit which control the vertical lifting rods for the hooks. In order to obtain good technical results with the aforesaid arrangement, the rockers are guided in an exact manner during their movements by slidable engagement of their pins in corresponding seats in a guide support, and are also guided exactly into their rest position by precise contact between rear flat surfaces of the rockers and the corresponding front flat surface of said support. In their turn, the rocker thrust rods are controlled by the vigorously vertical movements of a rake member driven by a lever and cam mechanism, whereas the pressure bars for said thrust rods are controlled by pins fixed to the ends thereof and driven against the action of return springs by cams controlled by the same shaft which controls the cam for said rake member.

BRIEF DESCRIPTION OF THE DRAWINGS

The invention is described hereinafter in greater detail by way of example with reference to a preferred embodiment thereof illustrated by the accompanying drawings, in which.

DESCRIPTION OF THE PREFERRED EMBODIMENT

Dobbies are mechanical apparatus by means of which the shed is formed in looms starting from a predetermined fabric design which is transferred in the form of code onto a punched tape, which when read by means of needles controls rocker levers which govern the movement of the heald frames.

Figure 1:
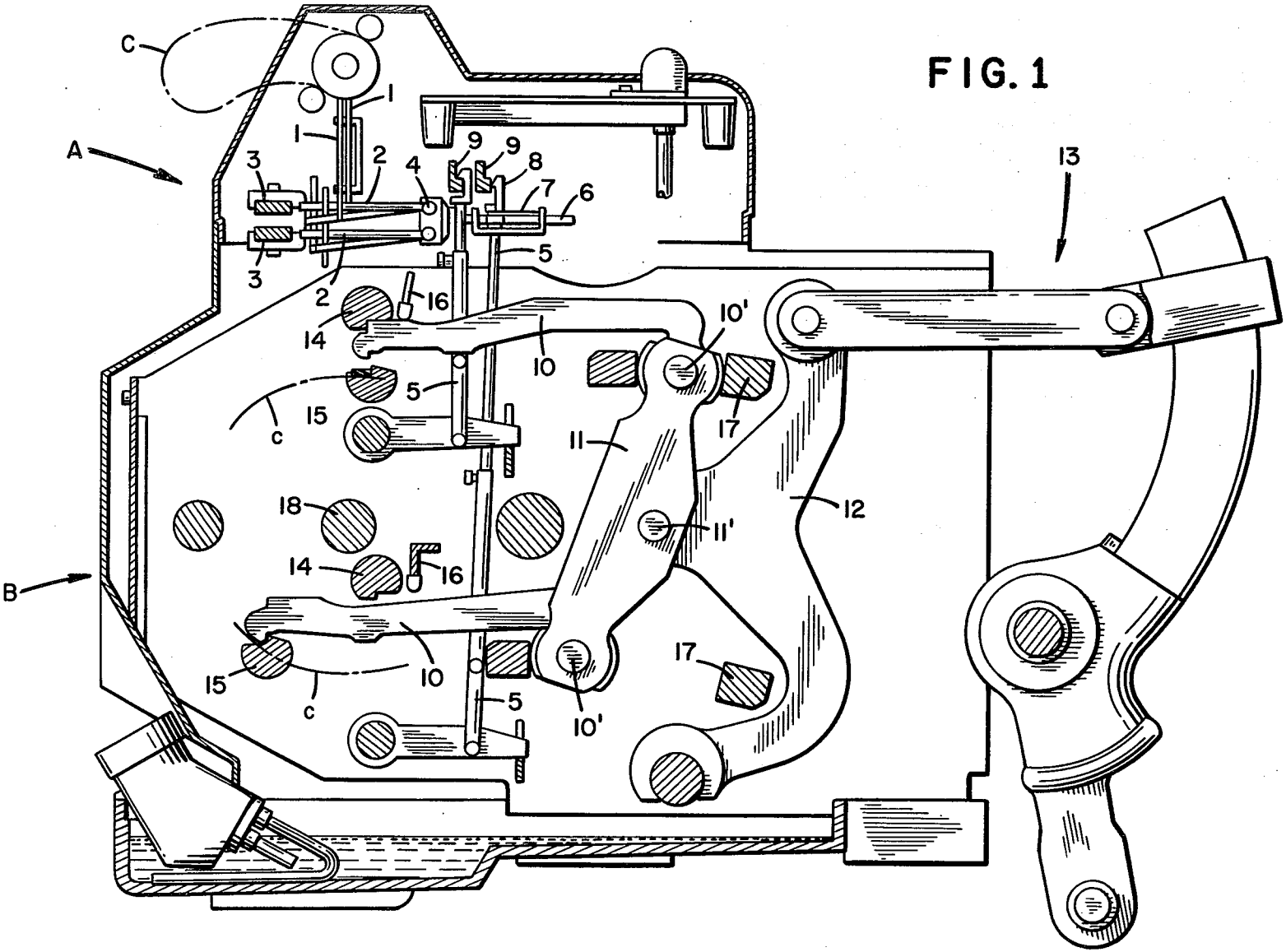
FIG. 1 is a general diagram of a dobby of known type comprising the improvements according to the invention.

FIG. 1 of the accompanying drawings represents a diagram of a known Hattersley dobby. This diagram shows a reading unit A and a control unit B. The purpose of the reading unit A is to read a punched paper tape C, and comprises reading needles 1, thrust rods 2 oscillating under the control of the needles 1, pressure bars 3 for engaging and thrusting the rods 2 selected by the needles 1, and control rockers 4 controlled by the rods 2. The purpose of the control unit B is to determine the movements of the heald frames under the control of the reading unit A, and comprises vertical control rods

5 controlled by horizontal needles 6 subjected to the action of the rockers 4 and of return springs 7 in order to establish and remove the engagement with lifting blades 9 by way of upper end hook portions 8. It also comprises hooks 10 pivoted at 10' to the ends of rocker levers 11 which in their turn are pivoted at 11' to the centre of transmission levers 12 which operate lever systems 13 for controlling the heald frames. The vertical rods 5 engage with the hooks 10 in order to raise them and lower them in accordance with commands received from the rockers 4 of the reading unit A. The hooks 10 engage with fixed knives 14 and mobile knives 15 in order to control the rocker levers 11. Engagement with the fixed knives 14 occurs when the rods 5 raise the hooks under the control of the lifting blades 9 with which the hook portions 8 cooperatate. Engagement with the mobile knives 14 occurs when the rods 5 do not exert positive force on the hooks. The movements impressed by the rocker levers 11 and transmission levers 12 on the lever systems 13 and thus on the heald frames, leading to the formation of the shed, derive from the combination of these engagements and the law governing the movement of the mobile knives 15.

It should be noted that in reality the fixed knives 14 have only their axes fixed, in the sense that they undergo oscillations about this latter for the purpose of facilitating their engagement with the hooks. In contrast, besides undergoing a similar oscillation about their axes (again to facilitate engagement with the hooks), the mobile knives move such that their axes travel along trajectories in the form of circular arcs c.

It should also be noted that the hooks as a rule are lowered under the positive control of hook lowering plates 16 which ensure disengagement of the hooks from the fixed knives and facilitate their engagement with the mobile knives.

As stated, the object of the invention is to obtain complete structural separation between the dobby reading unit A and the dobby control unit B. For this purpose, the horizontal needles 6 which receive their command from the rockers 4 are made completely separate therefrom, the rockers acting on the needles by simply bearing and thrust contact by way of a tappet 17. Such an arrangement of the reading and control members, which is very useful from the machine constructional, maintenance and operational aspects, requires a very rigorous guide for the rockers 4. This guide shown in FIG. 2, comprises a fixed support 18 containing cylindrical bores in which pins 19 rigidly fixed to the rockers 4 slide in a precisely guided manner. The support 18 comprises slots 20 for freely housing the thrust rods 2 pivoted at 2' to the rockers 4, and a precisely flat front resting surface 21 for the rockers 4 (which engage it by way of their rear surfaces 22, also rigorously flat, under the action of the needles 6 pressed by the springs 7). In this manner, the rockers 4 are guided in a rigorous manner both during their horizontal movements and into their rest position, as is essential for proper operation of the dobby. In particular, correct horizontal movement of the rockers 4 is essential for exact control of the needles 6 by the tappet 17, because of the fact that in the arrangement according to the invention there is no longer the continuity characteristic of conventional machines between the needles and rockers, and in addition a precise rest position for the rockers 4 is essential for correct vertical sliding of the rods 5 in the respective seats 6' of the needles 6 when said rods receive commands from the lifting blades 9 (in order to prevent friction or forcing).

Figure 3:
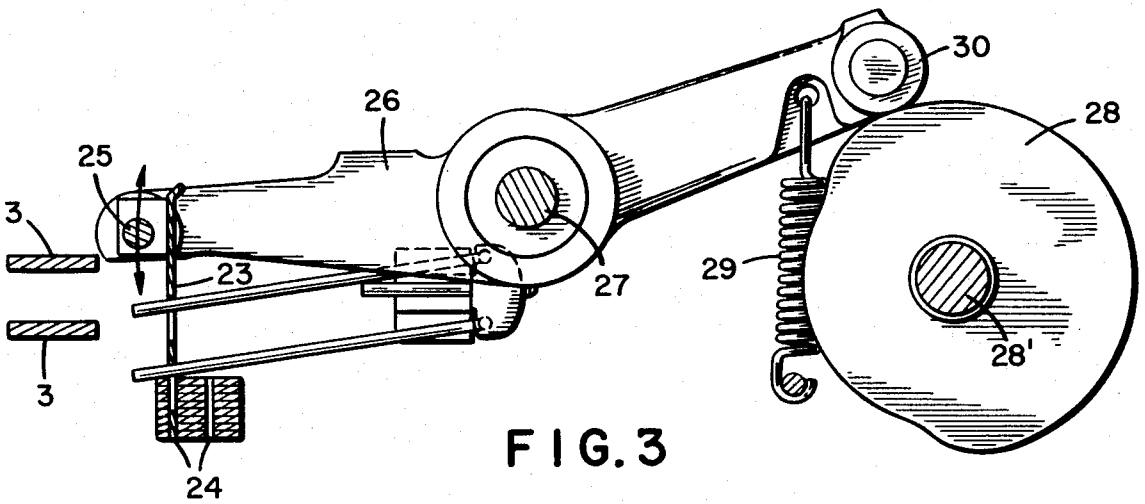
FIG. 3 is a detailed view of the means for controlling the movements of the thrust rods of the reading unit rockers.
Figure 2:
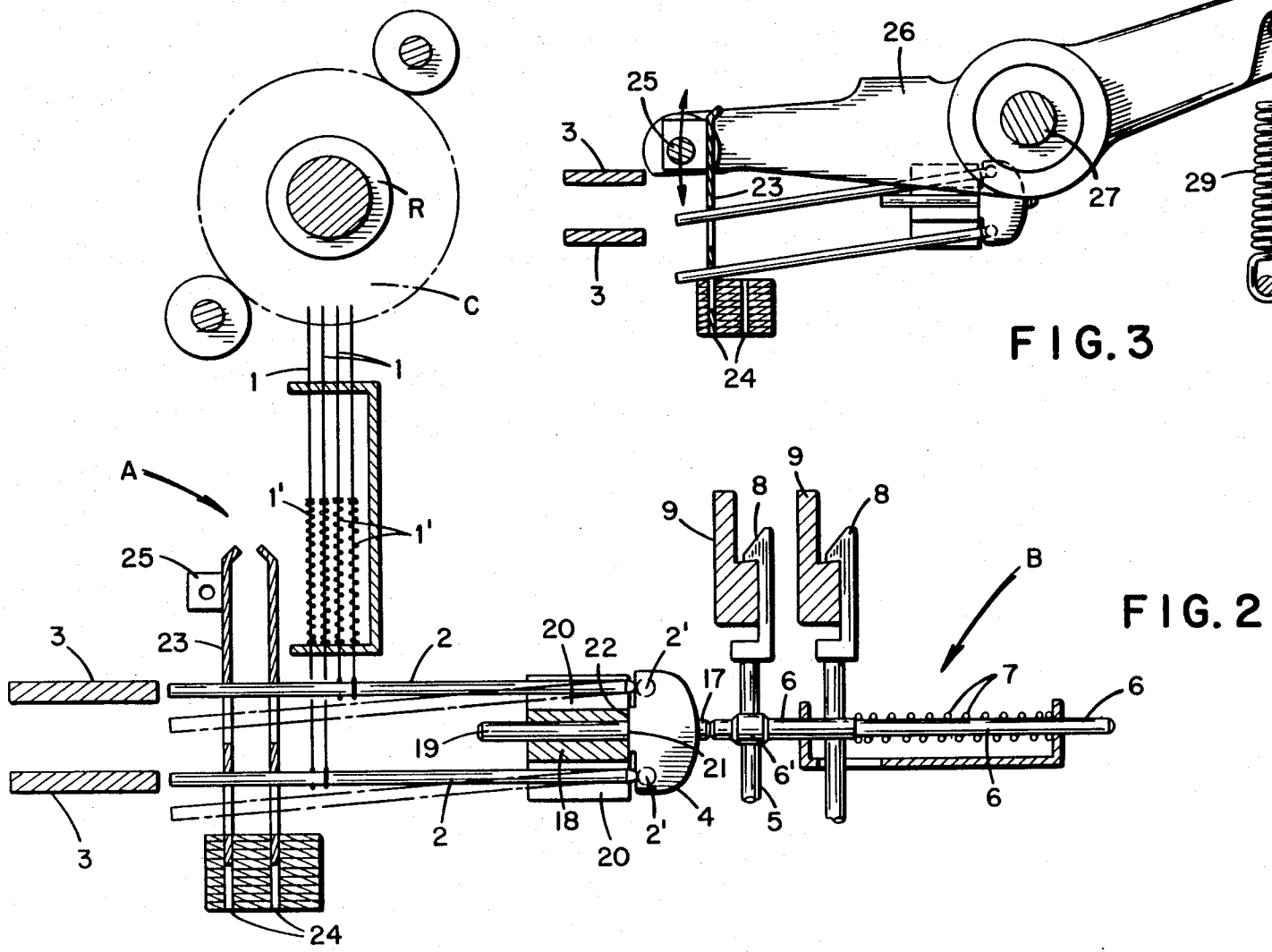
FIG. 2 is a detailed view of those members of the dobby reading unit and control unit of FIG. 1 which directly cooperate with each other.

In the arrangement according to the invention, the thrust needles 2 are controlled on the one hand by needles 1 which under the action of springs 1' to cooperate with the coded design on the punched paper tape C mobile on the roller R, and on the other hand by a rake member 23 mobile along a rigorously vertical trajectory imposed by guides 24 and controlled by the lever system shown in FIG. 3, which engages its lug 25 (FIGS. 2 and 3). The lever system for controlling the rake member 23 comprises a bent lever 26 pivoted on a fixed pin 27 and having one end hinged to the lug 25 and the other end controlled by a cam 28 (with a shaft 28') against which it is urged into contact by a spring 29 by way of a cam follower 30.

Figure 4:
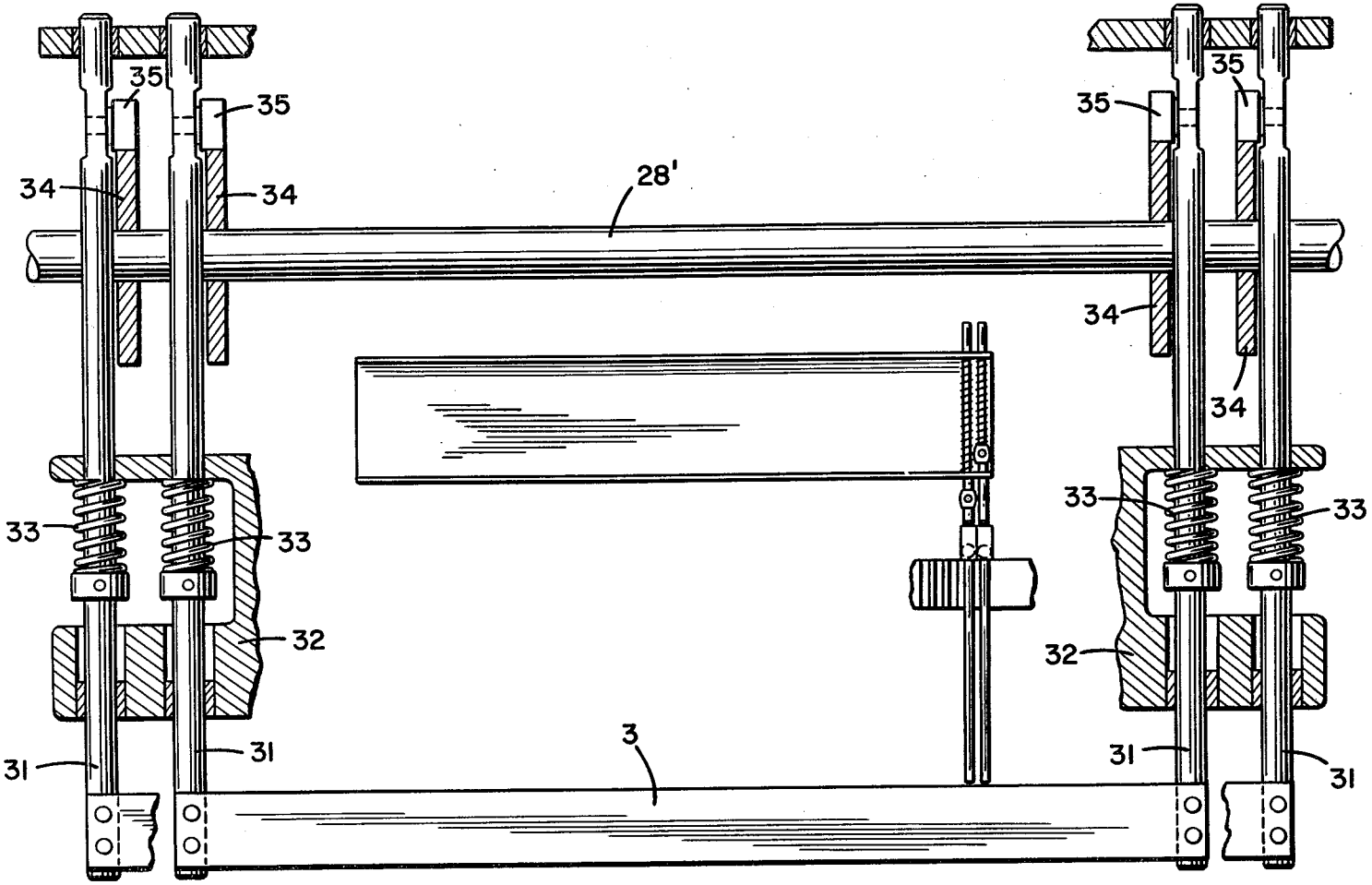
FIG. 4 is a detailed view of the means for controlling the pressure bars of said reading unit.

Finally, FIG. 4 shows the control means for the pressure bars 3 which control the thrust rods 2 of the dobby reading unit according to the invention. These means comprise pins 31 fixed to the ends of the bars 3 and axially slidable in fixed guides 32 against the action of return springs 33 and under the control of the disc cams 34 acting on rollers 35 mounted on the pins 31 and rotatable about axes transverse to the axes of said pins 31. The disc cams 34 are controlled by the same shaft 28' which controls the cam 28 which operates the rake member 23 for the thrust rods 2.

Modifications can be made to the represented embodiment which fall within the scope of the present invention.

I claim:

1. A dobby for forming the shed in looms, comprising a unit for reading the fabric design reproduced in code on punched paper tape having tappets on rockers and a control unit for heald frame lever systems having horizontal needles, said reading unit being structurally separate from the control unit, the reading unit acting on the control unit by bearing and thrust contact between said tappets on reading unit rockers and ends of the horizontal needles of the control unit which control the vertical lifting rods for the hooks.

2. A dobby as claimed in claim 1, including a guide support having seats and wherein said rockers having pins are guided in an exact manner during their movements by the slidable engagement of their pins in corresponding seats of said guide support which also comprises seats for freely housing rocker thrust rods, and are also guided exactly into their rest position by precise contact in said rest position, between flat rear surfaces of the rockers and a corresponding flat front surface of said support.

3. A dobby as claimed in claim 2, including a rake member, cam drive, bent lever and guides and wherein said rocker thrust rods are controlled by rigorously vertical movements of said rake member which are obtained by means of said cam drive by way of said bent lever, and are controlled by said guides.

4. A dobby as claimed in claim 3, including pressure bars, pins, return springs and cams, said pressure bars for said thrust rods being controlled by said pins fixed to their ends and driven against the action of said return springs, by said cams controlled by the same shaft which controls the cam drive for the bent lever for said rake member.

* * * * *